US009765519B2

(12) United States Patent
Bergman

(10) Patent No.: US 9,765,519 B2
(45) **Date of Patent: *Sep. 19, 2017**

(54) CEILING SYSTEM

(71) Applicant: ARMSTRONG WORLD INDUSTRIES, INC., Lancaster, PA (US)

(72) Inventor: Todd M. Bergman, Lititz, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/044,761

(22) Filed: Feb. 16, 2016

(65) Prior Publication Data

US 2016/0168852 A1 Jun. 16, 2016

Related U.S. Application Data

(63) Continuation of application No. 14/204,299, filed on Mar. 11, 2014, now Pat. No. 9,279,251, which is a (Continued)

(51) Int. Cl.
*E04B 9/00* (2006.01)
*E04B 9/22* (2006.01)
(Continued)

(52) U.S. Cl.
CPC ..... *E04B 9/34* (2013.01); *E04B 9/008* (2013.01); *E04B 9/205* (2013.01); *E04B 9/225* (2013.01);
(Continued)

(58) Field of Classification Search
CPC ..... E04B 9/006; E04B 9/008; E04B 9/225; E04B 9/22; E04B 2/827; G09F 2007/186
See application file for complete search history.

(56) References Cited

U.S. PATENT DOCUMENTS 2,386,887 A * 10/1945 Eckel ..... E04B 9/22 248/300
2,499,278 A 2/1950 Olsen
(Continued)

FOREIGN PATENT DOCUMENTS

EP 0197594 A2 10/1986
JP 06257234 A * 9/1994
(Continued)

OTHER PUBLICATIONS

International Search Report dated Aug. 23, 2012, for PCT/US2012/38339, Filed May 17, 2012. WO.

*Primary Examiner* — Ryan Kwiecinski
(74) *Attorney, Agent, or Firm* — Craig M. Sterner

(57) ABSTRACT

A ceiling system including vertically oriented panel structures. The ceiling system may include a panel structure having first and second exposed major surfaces and a peripheral edge. A first mounting element may be coupled to the panel structure. The first mounting element may include a first portion embedded between the first and second exposed major surfaces of the panel structure and a second portion protruding from the peripheral edge of the panel structure. The second portion of the first mounting element may include a connection feature for attaching to an overhead support member. Each panel structure may have two of the mounting elements coupled thereto, and each of the mounting elements may be configured for attachment to a different overhead support member. A plurality of the panel structures may be vertically suspended from the overhead support members.

19 Claims, 10 Drawing Sheets

Related U.S. Application Data continuation of application No. 13/474,077, filed on May 17, 2012, now Pat. No. 8,695,296.

(60) Provisional application No. 61/486,991, filed on May 17, 2011.

(51) Int. Cl.

| | |
|---|---|
| ***E04B 9/34*** | (2006.01) |
| ***E04B 9/24*** | (2006.01) |
| ***E04B 9/36*** | (2006.01) |
| ***E04B 9/20*** | (2006.01) |
| *G09F 7/18* | (2006.01) |

(52) U.S. Cl.

CPC ..... *E04B 9/24* (2013.01); *E04B 9/366* (2013.01); *G09F 2007/186* (2013.01)

(56) References Cited

U.S. PATENT DOCUMENTS

| | | | | |
|---|---|---|---|---|
| 3,567,169 | A | 3/1971 | Frederick et al. | |
| 3,986,314 | A | 10/1976 | Moeller | |
| 4,031,664 | A * | 6/1977 | Wendt | E04B 1/6116 248/300 |
| 4,197,923 | A * | 4/1980 | Harris | E04B 1/86 181/287 |
| 4,200,171 | A * | 4/1980 | Seymour | E04B 1/86 16/87 R |
| 4,703,598 | A | 11/1987 | Wilson et al. | |
| 4,709,888 | A | 12/1987 | Cubit et al. | |
| 4,723,749 | A * | 2/1988 | Carraro | E04B 9/18 24/336 |
| 4,726,165 | A | 2/1988 | Brinsa | |
| 4,827,687 | A | 5/1989 | Frawley | |
| 5,468,035 | A | 11/1995 | Fountain | |
| 5,480,116 | A * | 1/1996 | Callas | G09F 7/08 248/228.4 |
| 5,623,130 | A | 4/1997 | Noxon | |
| 6,260,810 | B1 | 7/2001 | Choi | |
| 6,637,710 | B2 * | 10/2003 | Yaphe | E04B 9/006 248/317 |
| 7,478,787 | B2 | 1/2009 | Bankston et al. | |
| 7,637,065 | B2 | 12/2009 | Ahren et al. | |
| 3,051,618 | A1 | 11/2011 | Ahren et al. | |
| 2002/0060280 | A1 | 5/2002 | Yaphe et al. | |
| 2006/0248826 | A1 * | 11/2006 | Owens | E04B 2/827 52/243.1 |
| 2007/0145222 | A1 | 6/2007 | Rausch | |
| 2010/0011699 | A1 | 1/2010 | Weimer et al. | |
| 2011/0232219 | A1 * | 9/2011 | Wilkinson, Jr. | G09F 7/18 52/474 |

FOREIGN PATENT DOCUMENTS

| | | |
|---|---|---|
| RU | 57774 U1 | 10/2006 |
| SU | 1725740 A3 | 4/1992 |

* cited by examiner

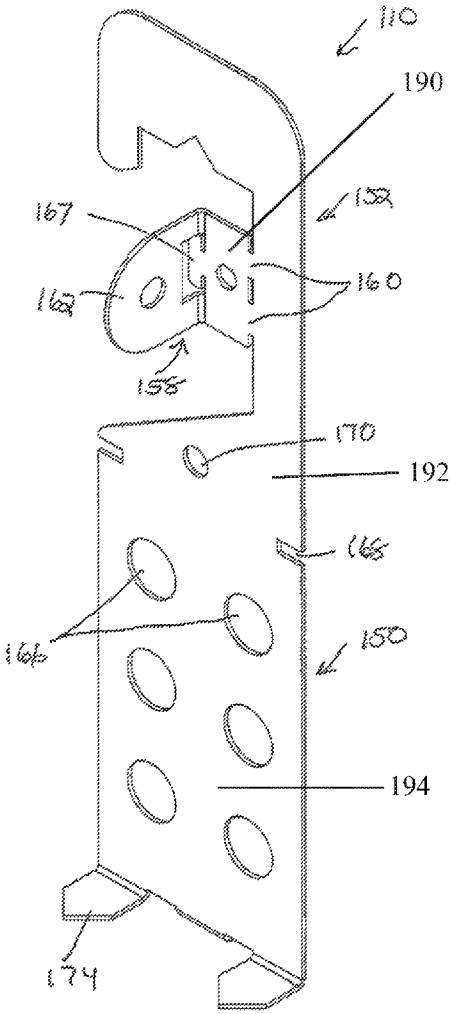
FIG. 13
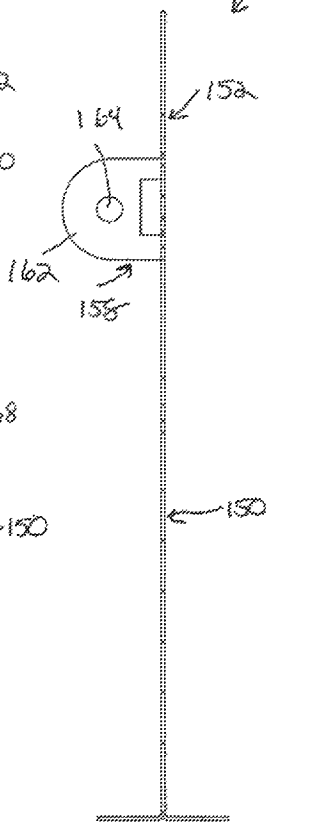
FIG. 15
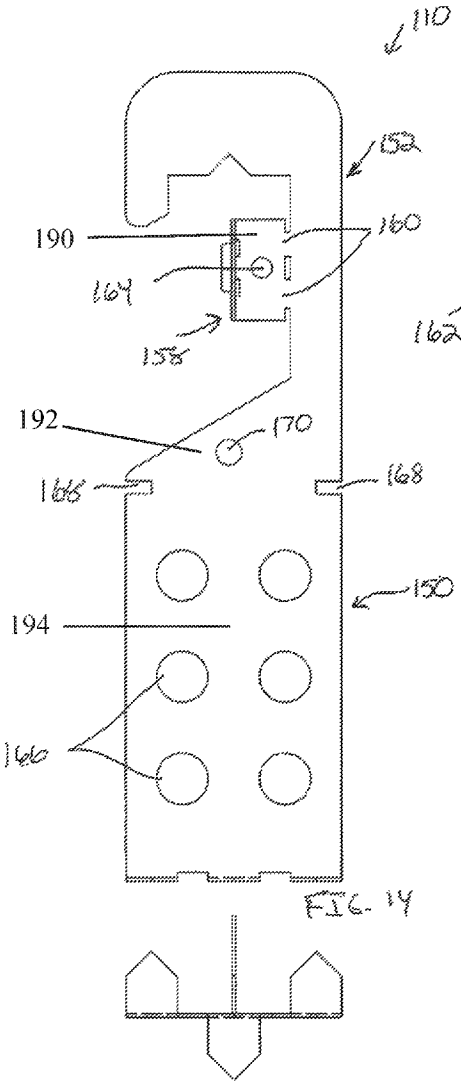
FIG. 14
FIG. 16

CEILING SYSTEM

CROSS-REFERENCE TO RELATED APPLICATIONS

The present application is a continuation of U.S. patent application Ser. No. 14/204,299, filed Mar. 11, 2014, which is a continuation of U.S. patent application Ser. No. 13/474,077, filed on May 17, 2012, now U.S. Pat. No. 8,695,296, which in turn claims the benefit of U.S. Provisional Patent Application Ser. No. 61/486,991, filed on May 17, 2011, the entireties of which are incorporated herein by reference.

FIELD OF THE INVENTION

The present invention is directed to a ceiling system having vertically extending acoustical ceiling panels.

BACKGROUND OF THE INVENTION

In many commercial buildings, it is desirable to alter room acoustics by providing vertically extending ceiling components intended to absorb sound waves to diminish room noise. In addition, vertically extending panels may be used to aesthetically separate areas of a large space with overhead panels or decorative valances projecting downward from a ceiling. These overhead panels are also referred to as soffits, valances, and bulkheads in different settings. Additionally, overhead panels may be connected to a ceiling to provide a vertical mounting surface for advertising information, menu information, or other displays in various retail establishments.

Generally, vertically extending panels are mounted using wires which are directly mounted to the ceiling. However, as the panels are mounted with wires or the like, the repair and replacement of the panels is made difficult, as there is no easy method of removing the panels from the wires. In addition, as the panels are mounted directly to the ceiling, in order to move or rearrange the panels requires that the wires be removed from the ceiling and reaffixed to the ceiling in a different location. This is both time consuming and costly. In addition, depending on the duct work, lighting, etc. found in the ceiling, the mounting of the panels in the proper position may be difficult to accomplish.

It would, therefore, be beneficial to provide mounting hardware and a mounting system which allowed the vertical panels to be easily removed and replaced, thereby allowing the repair or replacement of damaged panels. It would also be beneficial to provide mounting hardware and a mounting system which allows for the repositioning of the panels as needed.

SUMMARY OF THE INVENTION

A ceiling system including vertically oriented panel structures. The ceiling system may include a panel structure having first and second exposed major surfaces and a peripheral edge. A first mounting element may be coupled to the panel structure. The first mounting element may include a first portion embedded between the first and second exposed major surfaces of the panel structure and a second portion protruding from the peripheral edge of the panel structure. The second portion of the first mounting element may include a connection feature for attaching to an overhead support member. Each panel structure may have two of the mounting elements coupled thereto, and each of the mounting elements may be configured for attachment to a different overhead support member. A plurality of the panel structures may be vertically suspended from the overhead support members.

In one aspect, the invention can be a ceiling system comprising: a panel structure having a first exposed major surface, a second exposed major surface, and a peripheral edge extending between the first and second exposed major surfaces of the panel structure; and a first mounting element comprising a first portion embedded between the first and second exposed major surfaces of the panel structure and a second portion protruding from the peripheral edge of the panel structure, the second portion comprising at least one connection feature configured for attachment to an overhead support member to suspend the panel structure with the first and second exposed major surfaces in a vertical orientation relative to a plane of a ceiling.

In another aspect, the invention can be a ceiling system comprising: a first overhead support member extending along a first longitudinal axis; a second overhead support member extending along a second longitudinal axis that is parallel to the first longitudinal axis; a first panel structure having a first exposed major surface, a second exposed major surface, and a peripheral edge extending between the first and second exposed major surfaces; a first mounting element comprising a first portion coupled to the first panel structure and a second portion coupled to the first overhead support member; and a second mounting element comprising a first portion coupled to the first panel structure and a second portion coupled to the second overhead support member; and wherein the first panel structure is vertically suspended from the first and second overhead support members.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

FIG. 13 is a perspective view of an alternate exemplary mounting hardware according the invention.

FIG. 14 is a side view of the exemplary mounting hardware shown in FIG. 13.

FIG. 15 is an end view of the exemplary mounting hardware shown in FIG. 13.

FIG. 16 is a bottom view of the exemplary mounting hardware shown in FIG. 13.

DETAILED DESCRIPTION OF THE INVENTION

Figure 1:
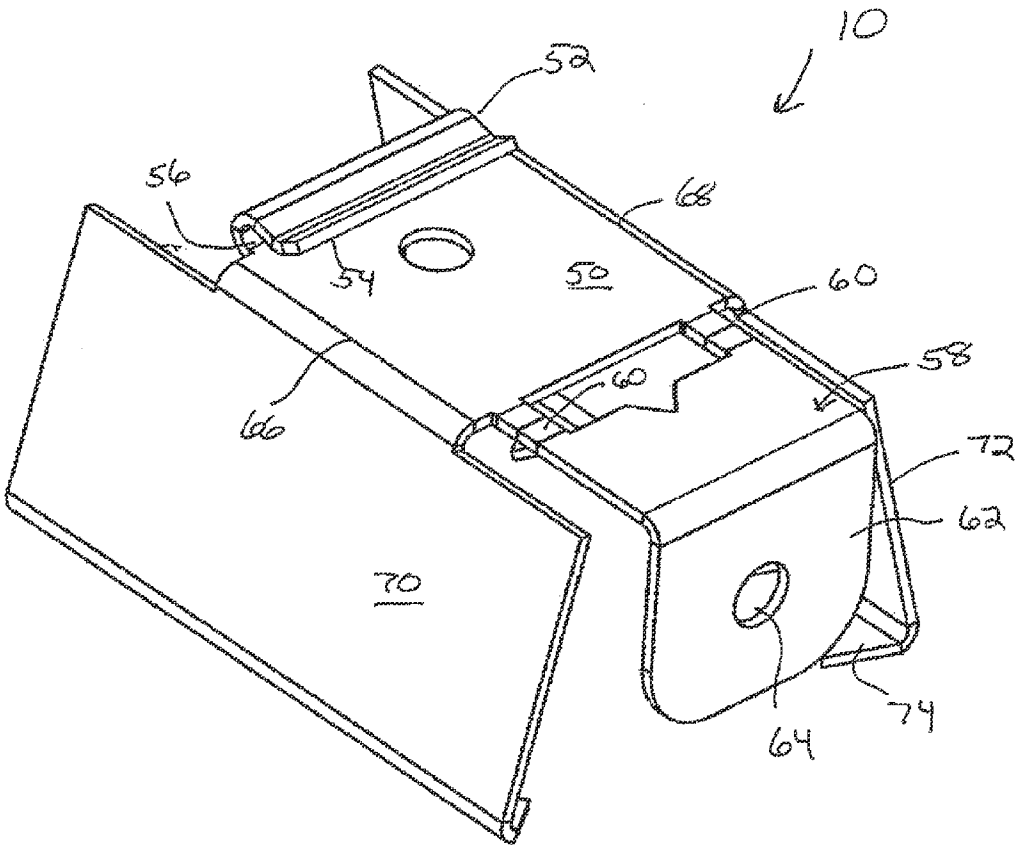
FIG. 1 is a perspective view of an exemplary mounting hardware according the invention.
Figure 2:
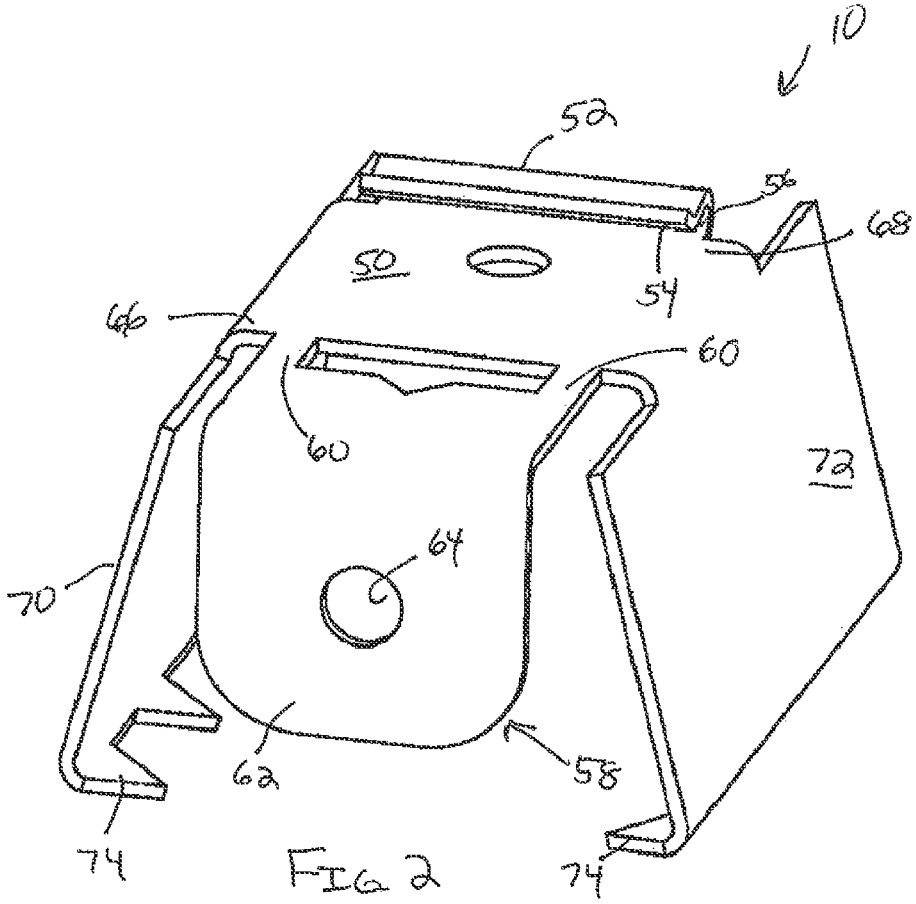
FIG. 2 is an alternate perspective view of the exemplary mounting hardware shown in FIG. 1.
Figure 3:
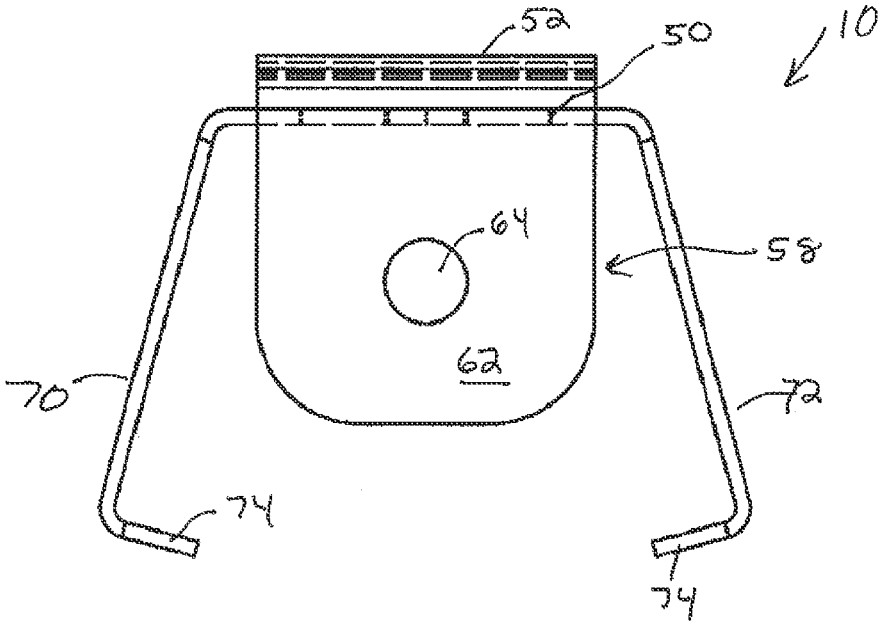
FIG. 3 is an end view of the exemplary mounting hardware shown in FIG. 1.
Figure 5:
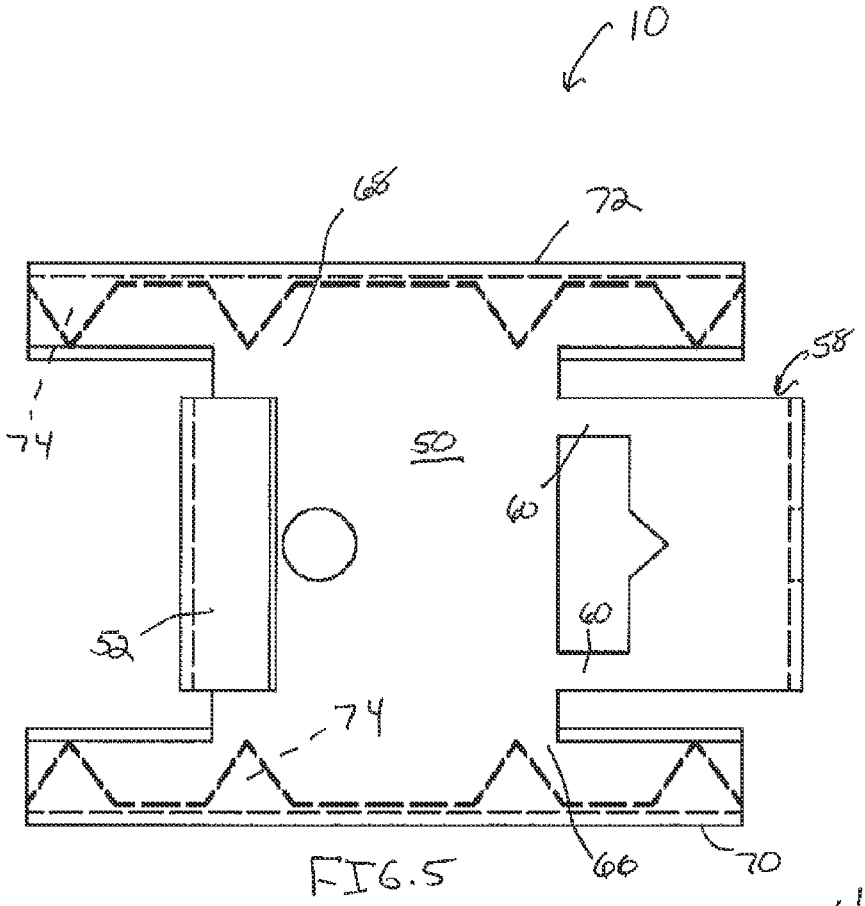
FIG. 5 is a top view of the exemplary mounting hardware shown in FIG. 1, with the teeth shown in phantom.
Figure 4:
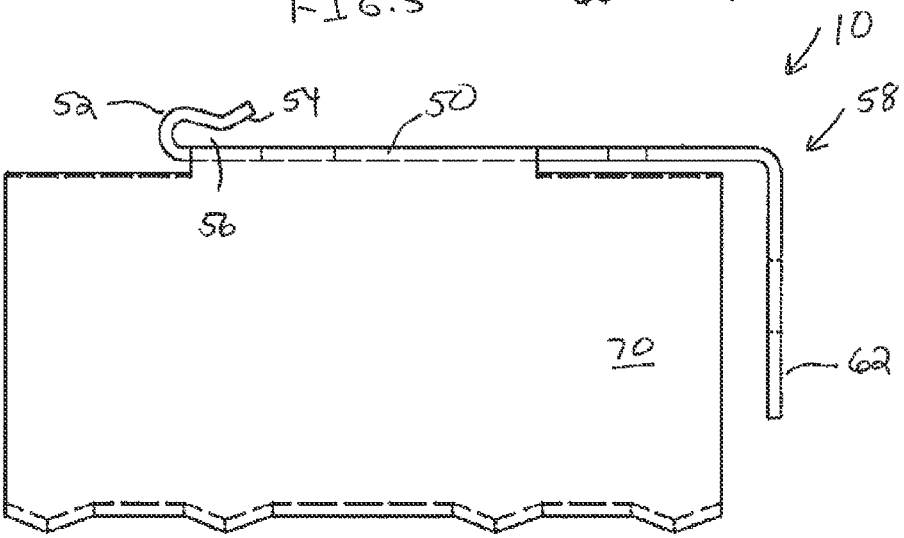
FIG. 4 is a side view of the exemplary mounting hardware shown in FIG. 1.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that spatially relative terms, such as "vertical", "horizontal", "upper", "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "upper" elements or features would then be oriented "lower" than the other elements or features. Thus, the exemplary term "upper" can encompass both an orientation of upper and lower. The device may be otherwise oriented (rotated 90 degrees or at other orientations) and the spatially relative descriptors used herein interpreted accordingly.

FIGS. 1 through 7 illustrate an exemplary embodiment of mounting hardware 10 and a mounting system 12 for mounting a vertical panel 14 to a structural support member 16 which is mounted to a ceiling or the like. The panels may be used for different purposes, including, but not limited to improving the acoustics of the space, aesthetically separating areas of a large space, or providing a vertical mounting surface for advertising information, menu information, or other displays in various retail establishments.

Figure 6:
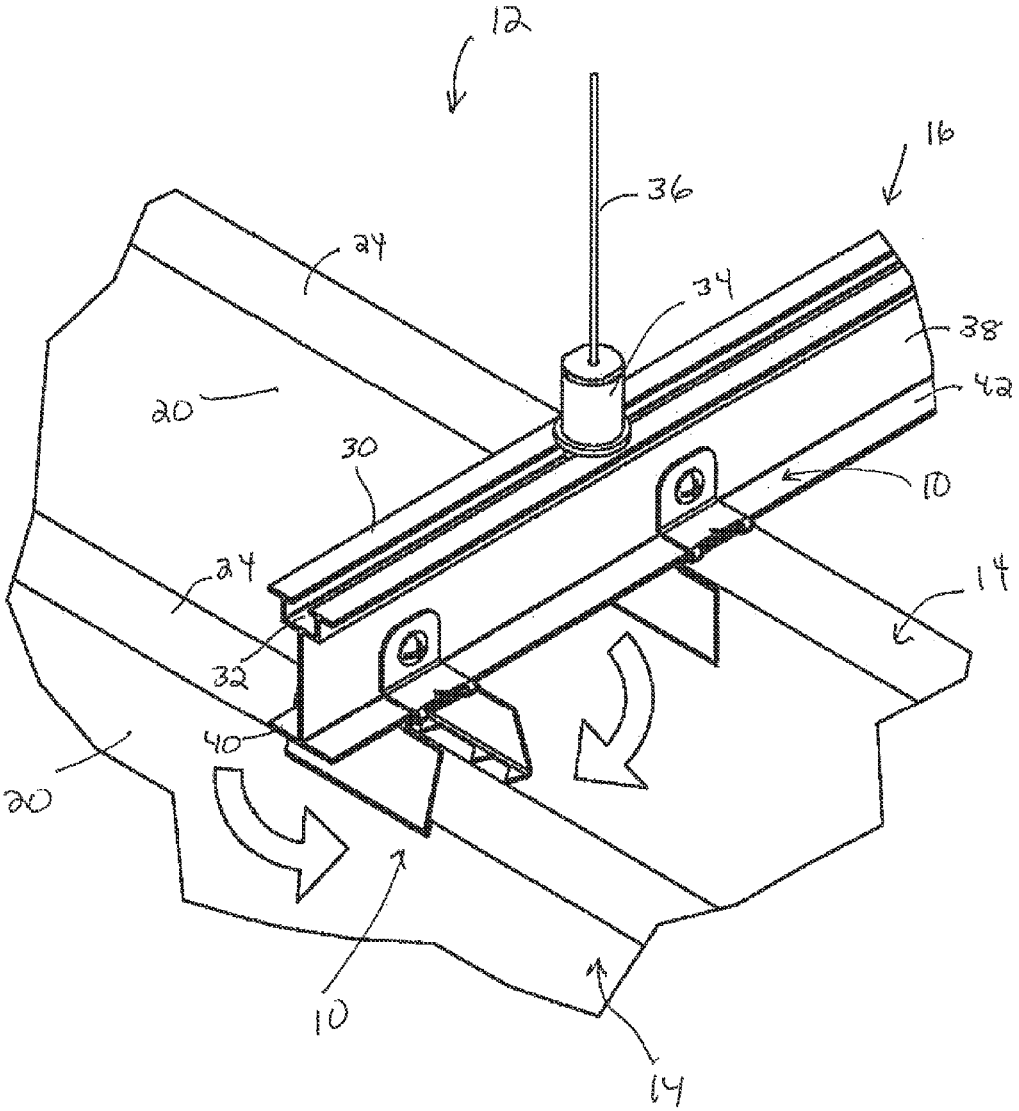
FIG. 6 is a perspective view of two panels positioned proximate a support member, with one of the mounting hardware shown in an open position and the other mounting hardware shown in a closed position.
Figure 7:
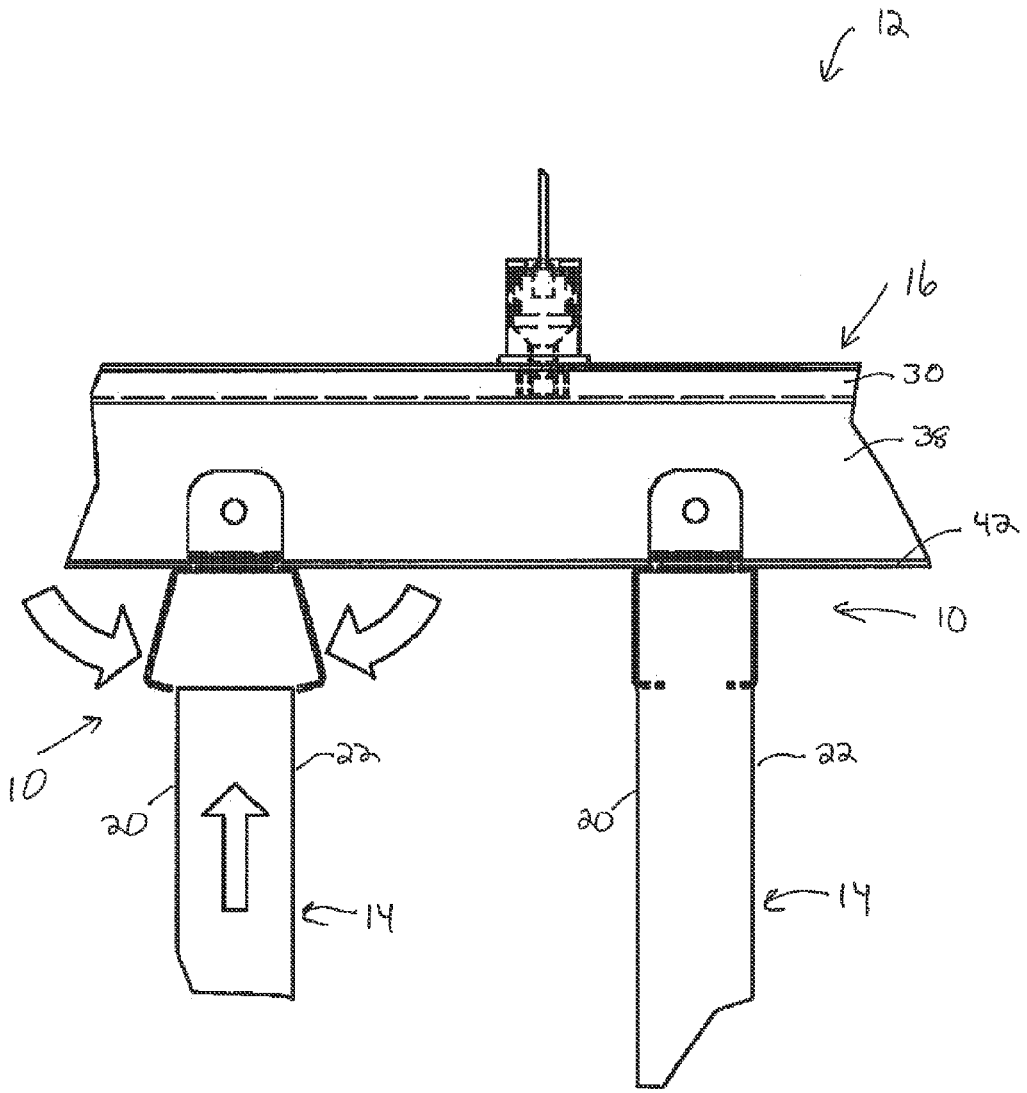
FIG. 7 is an end view of the two panels, support member and mounting hardware shown in FIG. 6.

In accordance with one exemplary embodiment of the invention, the mounting system 12 provides a platform for mounting at least one overhead, vertical panel 14 that is supported on the support member 16, as will be discussed in further detail below. The overhead panel 14 drops down in a generally vertical orientation from the plane of the ceiling and can be combined with additional panels 14 or used individually. FIGS. 6 and 7 illustrate a perspective view of the overhead mounting system 12 in accordance with one exemplary embodiment. The mounting system 12 includes one or more support members 16, the mounting hardware 10, and one or more panels 14.

Figure 12A:
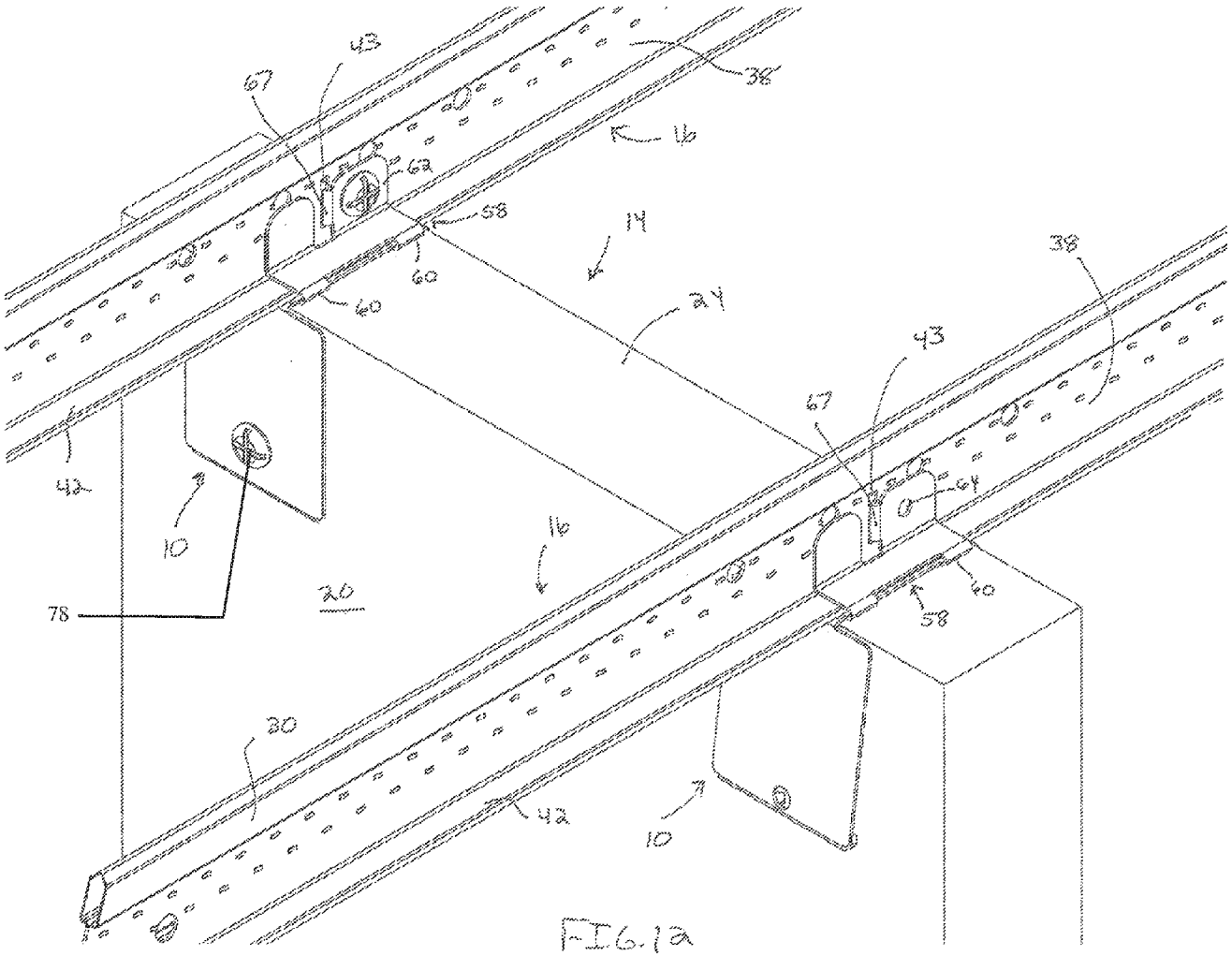
FIG. 12 is a perspective view of a panel positioned proximate to and mounted on two support members.

The panels 14 are any known panels which perform the desired function. As is best shown in FIGS. 6, 7 and 12, in general, the panels are made from lightweight material having a first surface 20 and an oppositely facing second surface 22. A mounting surface or edge 24 extends between the first surface 20 and the second surface 22. In the exemplary embodiment shown, the panels 14 are rectangular, however, the panel can take any suitable shape, length, or width. While other embodiments may be used, in one example the panel 14 contains a cellular core having first and second side walls that are covered by a veneer or laminated outer skin. The veneer or outer skin may be any color according to the aesthetic desired. The cellular core may be made of a foam material, such as, but not limited to polystyrene that allows the vertical panel to be lightweight, for example, around 1-2 pounds per linear foot of elongate length. The outer skin may be formed of a suitable lightweight material, such as, but not limited to, material having the acoustic properties required, high impact polystyrene or expanded PVC. The type of material will depend upon the application for which the panel is to be used.

As is best shown in FIGS. 6, 7 and 12, in the exemplary embodiment shown, the support members 16 have a modified I-shaped cross-section, which is most clearly shown in FIG. 6. The support member 16 has a top mounting section 30 having a slot 32 for receiving an end 34 of a mounting wire 36 which is mounted to the ceiling or the like. However, other configurations of the top mounting section 30 and other methods of mounting the support member 16 to the ceiling can be used without departing from the scope of the invention. A vertical flange 38 extends between the mounting section 30 and horizontal cross members or flanges 40, 42. As shown in the alternate embodiment of FIG. 12, locating slots 43 may also be provided periodically along the vertical flange 38.

According to the exemplary embodiment, the mounting hardware or mounting clip 10 includes an upper generally horizontal plate 50 with a support member receiving portion or flange receiving portion or hook arm 52 which extends from one end thereof. The hook arm 52 has a lead-in surface 54 and a slot 56. Extending from the other end of the horizontal plate 50 is a movable mounting section 58. The movable mounting section 58 has connection legs 60 which extend between the plate section 50 and the mounting section 58, the legs 60 being configured to allow the mounting section 58 to rotate about the plate section 50. Specifically, the mounting section 58 is rotatable about a first rotational axis B-B. The mounting section 58 has a mounting flange 62 with a screw receiving opening 64 which extends therethrough. As shown in the alternate exemplary embodiment of FIG. 8 through 12, a locating tab 67 may also be provided on the mounting section 58.

Figure 8:
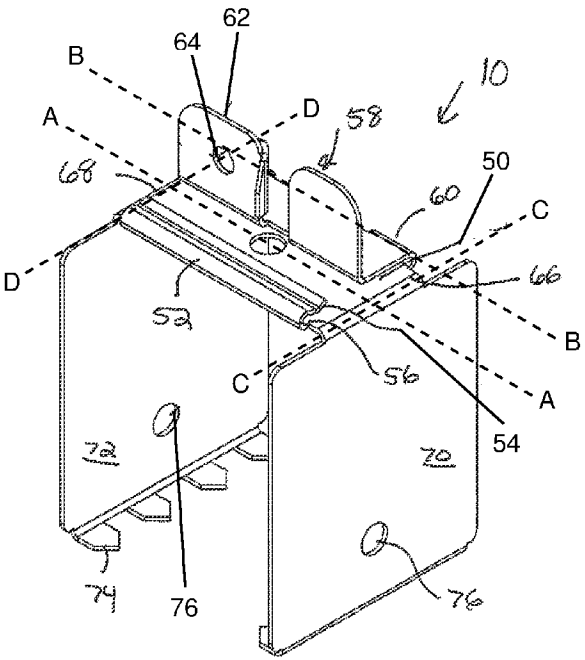
FIG. 8 is a perspective view of an alternate exemplary mounting hardware according the invention.
Figure 10:
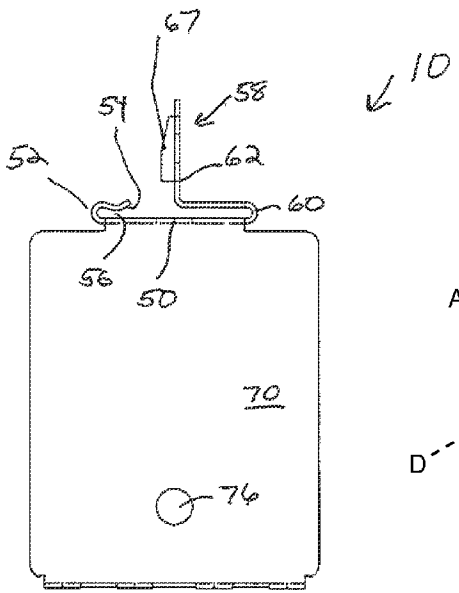
FIG. 10 is a side view of the exemplary mounting hardware shown in FIG. 8.
Figure 9:
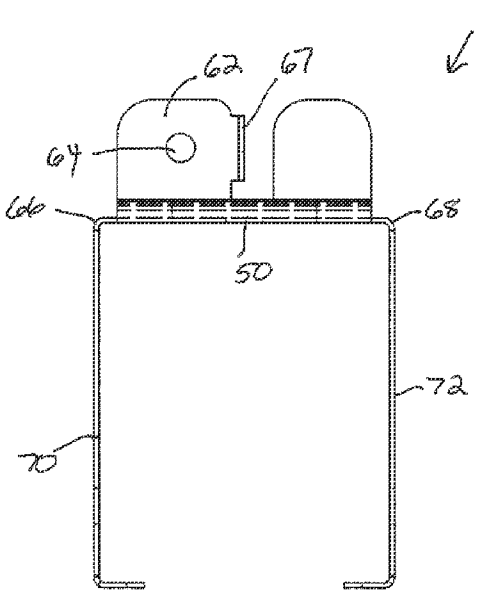
FIG. 9 is an end view of the exemplary mounting hardware shown in FIG. 8.
Figure 11:
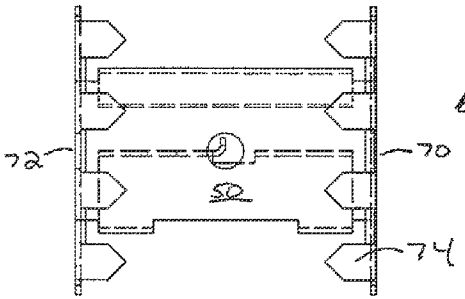
FIG. 11 is a bottom view of the exemplary mounting hardware shown in FIG. 8.

The plate section 50 has a first edge 66 and an oppositely facing second edge 68. A plate axis A-A extends between the first edge 66 and the second edge 68, as illustrated in FIG. 8. The first rotational axis B-B about which the mounting section 58 rotates is substantially parallel to the plate axis A-A (FIG. 8). A first vertical sidewall section 70 extends downwardly from the plate section 50 at the first edge 66. A second vertical sidewall section 72 extends downwardly from the plate section 50 at the second edge 68. The first and second vertical sidewall sections 70, 72 extend from the plate section 50 such that the first and second vertical sidewall sections 70, 72 are allowed to rotate or pivot about the plate section 50 allowing the first and second vertical sidewall sections 70, 72 to be moved between an open and a closed position. More specifically, the first vertical sidewall section 70 is rotatable about a second rotational axis C-C and the vertical sidewall section 72 is rotatable about a third rotational axis D-D. The second rotational axis C-C and the third rotational axis D-D are substantially traverse to the plate axis A-A (FIG. 8). The plate section 50 and the first and second vertical sidewall sections 70, 72 form a panel mounting section. The first and second vertical sidewall sections 70, 72 include a plurality of teeth 74, which, in the exemplary embodiment shown, are also formed along the length of the sidewall sections 70, 72 proximate the edge of the first and second vertical sidewall sections 70, 72 which are furthest from the plate section 50. The teeth 74 are substantially in alignment on both the first and second vertical sidewall sections 70, 72 so that the teeth 74 are in general vertical alignment with each other in elevation when the first and second vertical sidewall sections 70, 72 are moved to the closed position, as will be more fully described. However, other configurations of the teeth 74 are possible without departing from the scope of the invention.

An optional opening 76 may be provided in the first and second vertical sidewall sections 70, 72. This opening is shown in the embodiment illustrated in FIGS. 8 through 12, however, the opening may be provided in other embodiments, including, but not limited to the embodiment shown in FIGS. 1 through 7. The openings 76 permit mounting hardware 78, such as, but not limited to, a nut and bolt, to extend through the openings.

Referring to FIGS. 6, 7 and 12, the mounting hardware or mounting clips 10 cooperate with the support members 16 to mount the panels 14 to the support members 16 and indirectly to the ceiling. The hook arm 52 of each respective mounting clip 10 is configured to wrap around a respective flange 40, 42 of the support member 16. The respective flange 40, 42 is guided into the slot 56 by lead-in surface 54. Once the respective flange 40, 42 is positioned in the slot 56, the movable mounting section 58 is rotated or pivoted about the connection legs 60, thereby allowing the mounting flange 62 to be moved proximate the vertical flange 38. As this occurs, the locating tab 67 may be inserted into a respective locating slot 37 to help properly position the mounting clip 10 relative to the support member 16. With the mounting flange 62 positioned proximate the vertical flange 38, a screw may be inserted into the screw receiving opening 64, thereby causing the mounting clips 10 to be securely fastened and positioned relative to the support members 16. The cooperation of the hooked arm 52 and the mounting flange 62 prevents the movement of the mounting clip 10 is in a direction which is perpendicular to the longitudinal axis of the support member 16. The use of the screw prevents the movement of the mounting clip 10 is a direction which is essentially parallel to the longitudinal axis of the support member 16.

With the mounting clip 10 properly mounted and maintained in position on the support member 16, the panel 14 is moved into engagement with the mounting clip 10. In order to facilitate the movement of the panel 14 into the mounting clip 10, the first and second vertical sidewall sections 70, 72 are spread apart in the open position. In this position, the first and second vertical sidewall sections 70, 72 are spread apart a distance greater than the width of the panel 14, thereby allowing the panel 14 to be inserted until is positioned proximate to or engages the plate section 50.

With the panel 14 properly inserted between the first and second vertical sidewall sections 70, 72, the first and second vertical sidewall sections 70, 72 are rotated inward, toward each other, thereby moving the first and second vertical sidewall sections 70, 72 from the open position to the closed position. As this occurs the teeth 74 engage and pierce the panel 14. As the teeth 74 dig into the panel and are maintained in this position when the first and second vertical sidewall sections 70, 72 are in the closed position, the panel is maintained in position relative to the mounting clips 10 and the support member 16. The configuration of the first and second vertical sidewall sections 70, 72 allows the first and second vertical sidewall sections 70, 72 to be rotate using a hand tool such as a pliers or the like. This allows the first and second vertical sidewall sections 70, 72 to exhibit a sufficient force on the panel 14 when the first and second vertical sidewall sections 70, 72 are in the closed position to maintain the panel 14 in position. Additionally, if the optional hardware 78 is used, the hardware provides additional support to the panel 14 and prevents the first and second vertical sidewall sections 70, 72 from moving back toward the open position. This provides additional safety in areas which have increased seismic activity.

Depending upon the configuration and size of the panels 14, each mounting clip 10 is long enough to provide sufficient teeth 74 to support the weight of the panel 10 in the vertical position or a combination mounting clips 10 are sufficient to support the weight of the panel 10 in the vertical position.

In the exemplary embodiments, if the screw is loosened, the mounting clips 10 may slide freely along the support member 16. This allows the mounting clips, and ultimately the panels 14, to be positioned and repositioned in the appropriate location to achieve the desired acoustic properties or the desired aesthetics.

While the exemplary embodiment described that the mounting clips 10 are mounted on the support member 16 first and the panels 14 are then mounted to the mounting clips 10, this is just one exemplary method of assembly. As one exemplary alternative, the panels 14 may be mounted to the mounting clips 10 prior to the mounting clips being mounted to the support member 16.

Another alternate exemplary embodiment, not shown, has first and second vertical sidewall sections with no teeth. The mounting hardware extends through the openings provides the support for the panel. In this embodiment the first and second vertical sidewall sections are fixed and do not move between and open and a closed position.

Figure 17:
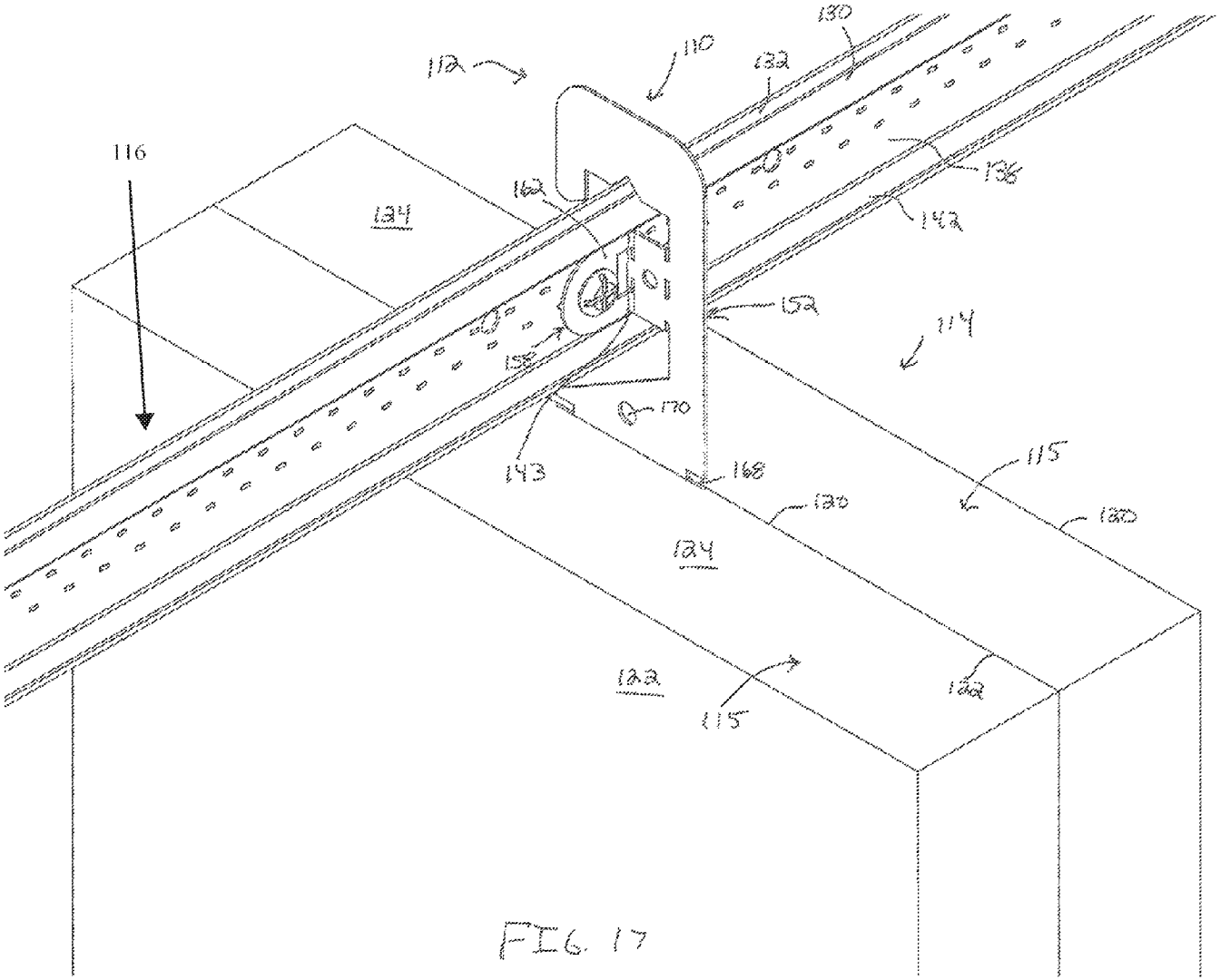
FIG. 17 is a perspective view of a panel mounted on the support member using the mounting hardware of FIG. 13.
Figure 18:
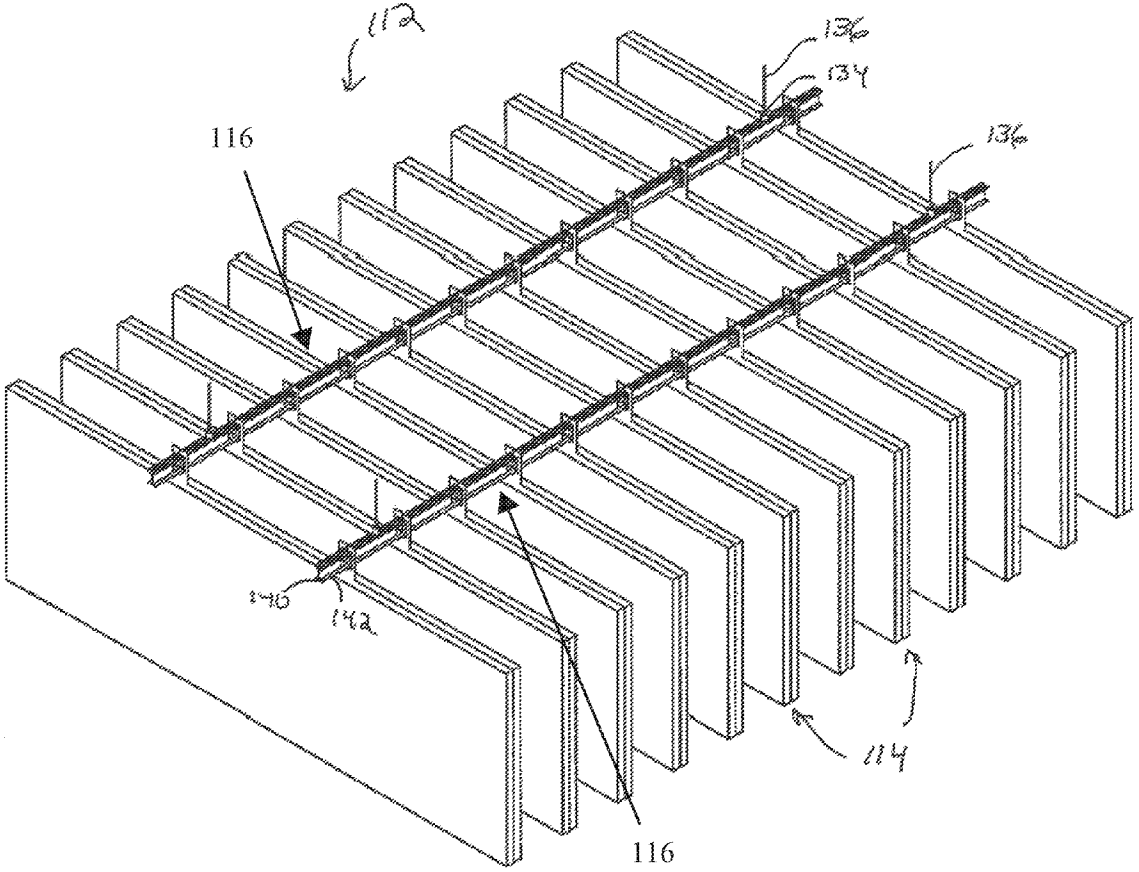
FIG. 18 is a perspective view of numerous panels mounted on the support member.

Another alternate exemplary embodiment is illustrated in FIGS. 13 through 18. The mounting system 112 provides a platform for mounting at least one overhead, vertical panel 114 that is supported on the support member 116, as will be discussed in further detail below. The overhead panel 114 drops down in a generally vertical orientation from the plane of the ceiling and can be combined with additional panels 114 (as shown in FIG. 17) or used individually. FIG. 18 illustrates a perspective view of the overhead mounting system 112 in accordance with this exemplary embodiment. The mounting system 112 includes one or more support members 116, the mounting hardware 110, and one or more panels 114.

The panels 114 are made by joining two panels 115. The panels 115 any known panels which perform the desired function. In general, each panel 115 is made from lightweight material having a first surface 120 and an oppositely facing second surface 122. A mounting surface or edge 124 extends between the first surface 120 and the second surface 122. In the exemplary embodiment shown, the panels 114 are rectangular, however, the panel can take any suitable shape, length, or width. While other embodiments may be used, in one example the panel 114 contains a cellular core having first and second side walls that are covered by a veneer or laminated outer skin. The veneer or outer skin may be any color according to the aesthetic desired. The cellular core may be made of a foam material, such as, but not limited to polystyrene that allows the vertical panel to be lightweight, for example, around 1-2 pounds per linear foot of elongate length. The outer skin may be formed of a suitable lightweight material, such as, but not limited to, material having the acoustic properties required, high impact polystyrene or expanded PVC. The type of material will depend upon the application for which the panel is to be used.

In the exemplary embodiment shown, the support members 116 have a modified I-shaped cross-section, which is most clearly shown in FIGS. 17 and 18. The support member 116 has a top mounting section 130 having a slot 132 for receiving and end 134 of a mounting wire 136 which is mounted to the ceiling or the like. However, other configurations of the top mounting section 130 and other methods of mounting the support member 116 to the ceiling can be used without departing from the scope of the invention. A vertical flange 138 extends between the mounting section 130 and horizontal cross members or flanges 140, 142. Locating slots 143 may also be provided periodically along the vertical flange 138.

According to the exemplary embodiment, the mounting hardware or mounting clip 110 includes a generally vertical plate section or panel mounting section 150 with a support member receiving portion or hook arm 152 which extends thereof. Extending from a portion of the hook arm 152 is a movable mounting section 158. The movable mounting section 158 has connection legs 160 which extend between the hook arm 152 and the mounting section 158, the legs 160 being configured to allow the mounting section 158 to rotate about the hook arm 152. The mounting section 158 has a mounting flange 162 with at least one screw receiving opening 164 which extends therethrough. More than one screw receiving opening 164 may be provided to allow the mounting section 158 to be bent to accommodate different support members 116 and still be secured thereto. A locating tab 167 may also be provided on the mounting section 158.

The configuration of the hook arm 152 is designed to allow the hook arm 152 to be inserted on standard grid, U-profiles, I-beam carrying members, peaked roof bulb design and other such configurations.

The plate section 150 has openings 166 which extend therethrough. The openings 166 allow adhesive to flow therethrough, as will be more fully described. Alignment notches 168 and a mounting opening 170 are also provided on the plate section 150. Projections or teeth 174 (as best shown in FIGS. 13 through 15), extend from both sides of the plate section 150. In the exemplary embodiment shown, the teeth 174 are formed along the edge of the plate section 150 which is furthest from the hook arm 152. The teeth 174 are in general vertical alignment with each other. However, other configurations of the teeth 174 are possible without departing from the scope of the invention.

In this embodiment, the mounting clips 110 are embedded in the panels 115 as the panels 115 are formed. Panels 114 have adhesive applied to facing surfaces. The panels 114 are moved together. As this occurs, the mounting clips 110 are positioned between the panels 114 such that the movement of the panels 114 together causes the mounting clips 110 to be captured between the panels 114. As this occurs, the teeth 174 engage and pierce the panels 114. Continued movement of the panels 114 toward each other causes the plate section 150 to be trapped between the panels 114. In this position, the adhesive applied to the panels 114 flows through the openings 166 to provide a strong bond between the panels 114 and the plate section 150. The alignment notches 168 are positioned proximate the top of the panels 114 to provide visual alignment as the panels and mounting clips 110 are joined together.

The mounting hardware or mounting clips 110 cooperate with the support members 116 to mount the panels 114 to the support members 16 and indirectly to the ceiling. As shown in FIG. 16, the hook arm 152 of each respective mounting clip 10 is configured to wrap around a respective the support member 116. Once the hook arm 152 is positioned on the support member 116, the movable mounting section 158 is rotated or pivoted about the connection legs 160, thereby allowing the mounting flange 162 to be moved proximate a vertical flange 138 of the support member 116. As this occurs, the locating tab 167 may be inserted into a respective locating slot 137 to help properly position the mounting clip 110 relative to the support member 116. With the mounting flange 162 positioned proximate the vertical flange 138, a screw may be inserted into either the appropriate screw receiving opening 164, thereby causing the mounting clips 110 to be securely fastened and positioned relative to the support members 116.

If the screw is loosened, the mounting clips 110 may slide freely along the support member 116. This allows the mounting clips, and ultimately the panels 114, to be positioned and repositioned in the appropriate location to achieve the desired acoustic properties or the desired aesthetics.

As will be appreciated from all of the embodiments, different number of panels can be mounted in differing configurations to accommodate the acoustic and/or aesthetic characteristics desired.

The mounting clips and mounting system allows for the panels to be removed and repaired/replaced if there is damage. There is no need to remove the mounting hardware or the mounting system in order to accomplish the repair/replacement.

The mounting clips and mounting system also allow for the repositioning of the panels. This allows for the panels to be repositioned as the needs or space changes.

The mounting clips and mounting system are also versatile. A wide range of materials and sizes of panels can be installed with the same hardware and same system, thereby reducing the need to change hardware.

The exemplary clips can be used to hang panels from standard grid, U-profiles, I-beam carrying members, peaked roof bulb design and other such configurations.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A suspended ceiling system comprising:

a first overhead support member extending along a first longitudinal axis;

a panel structure having a first exposed major surface, a second exposed major surface, and a peripheral edge extending between the first and second exposed major surfaces of the panel structure; and a first mounting element comprising a first portion embedded between the first and second exposed major surfaces of the panel structure and a second portion protruding from the peripheral edge of the panel structure, the second portion comprising at least one connection feature configured for attachment to the first overhead support member to suspend the panel structure with the first and second exposed major surfaces in a vertical orientation relative to a plane of a ceiling; and wherein the first mounting element comprises a first major surface and an opposite second major surface that are parallel to the first and second exposed major surfaces of the panel structure, and wherein the at least one connection feature comprises a first opening extending through the first and second major surfaces of the first mounting element at a location adjacent to a top edge of the panel structure; and wherein the second portion of the first mounting element is coupled to the first overhead support member such that the panel structure is suspended from the first overhead support member.

2. The ceiling system of claim 1 wherein the peripheral edge comprises the top edge, a bottom edge, a first lateral edge, and a second lateral edge, the panel structure extending along an axis from the bottom edge to the top edge, and wherein the second portion of the first mounting element protrudes from the top edge of the panel structure in a direction of the axis of the panel structure.

3. The ceiling system of claim 1 wherein the panel structure comprises:

a first panel comprising a first major surface that forms the first exposed major surface of the panel structure and an opposite second major surface;

a second panel comprising a first major surface and an opposite second major surface that forms the second exposed major surface of the panel structure; and wherein the second major surface of the first panel is coupled to the first major surface of the second panel to form the panel structure.

4. The ceiling system of claim 3 wherein the first portion of the first mounting element is sandwiched between the second major surface of the first panel and the first major surface of the second panel.

5. The ceiling system of claim 3 wherein the first and second panels are fixedly coupled together via an adhesive disposed on at least one of the second major surface of the first panel and the first major surface of the second panel.

6. The ceiling system of claim 1 wherein the at least one connection feature comprises a mounting flange extending perpendicularly from one of the first and second major surfaces of the first mounting element and comprising a second opening extending therethrough.

7. The ceiling system of claim 1 further comprising a second mounting element comprising a first portion embedded between the first and second exposed major surfaces of the panel structure and a second portion protruding from the peripheral edge of the panel structure.

8. The ceiling system of claim 1 wherein the second portion of the first mounting element comprises a vertical edge extending between the first and second major surfaces thereof.

9. The ceiling system of claim 1 further comprising a second mounting element comprising a first portion disposed between the first and second exposed major surfaces of the panel structure and a second portion protruding from the peripheral edge of the panel structure.

10. The ceiling system of claim 9 further comprising:

a second overhead support member extending along a second longitudinal axis that is parallel to the first longitudinal axis; and wherein the second portion of the second mounting element is coupled to the second overhead support member so that the panel structure is vertically suspended from the first and second overhead support members.

11. The ceiling system of claim 10 further comprising:

a second panel structure having a first exposed major surface, a second exposed major surface, and a peripheral edge extending between the first and second exposed major surfaces;

a third mounting element comprising a first portion coupled to the second panel structure and a second portion coupled to the first overhead support member; and a fourth mounting element comprising a first portion coupled to the second panel structure and a second portion coupled to the second overhead support member;

wherein the second panel structure is vertically suspended from the first and second overhead support members in a spaced apart manner from the first panel structure.

12. The ceiling system of claim 11 wherein the first exposed major surface of the second panel structure is adjacent to and faces the second exposed major surface of the panel structure.

13. The ceiling system of claim 1 further comprising:

a second panel structure having a first exposed major surface, a second exposed major surface, and a peripheral edge extending between the first and second exposed major surfaces;

a third mounting element comprising a first portion coupled to the second panel structure and a second portion protruding from the peripheral edge of the second panel structure, the second portion of the third mounting element configured for attachment to the first overhead support member to suspend the second panel structure with the first and second exposed major surfaces of the second panel structure in a vertical orientation relative to a plane of the ceiling; and wherein the second panel structure is vertically suspended in a spaced apart manner from the panel structure.

14. The ceiling system of claim 13 wherein the panel structure and the second panel structure are suspended from the overhead support member in an arrangement such that the first exposed major surface of the second panel structure faces the second exposed major surface of the panel structure.

15. The ceiling system of claim 13 wherein the second portion of the third mounting element is coupled to the first overhead support member.

16. The ceiling system of claim 1 further comprising:

a second overhead support member extending along a second longitudinal axis that is parallel to the first longitudinal axis;

a second mounting element comprising a first portion disposed between the first and second exposed major surfaces of the panel structure and a second portion protruding from the peripheral edge of the panel structure, the second portion of the second mounting element is coupled to the second overhead support member so that the panel structure is vertically suspended from the first and second overhead support members;

a second panel structure having a first exposed major surface, a second exposed major surface, and a peripheral edge extending between the first and second exposed major surfaces;

a third mounting element comprising a first portion coupled to the second panel structure and a second portion coupled to the first overhead support member; and a fourth mounting element comprising a first portion coupled to the second panel structure and a second portion coupled to the second overhead support member; and wherein the second panel structure is vertically suspended from the first and second overhead support members in a spaced apart manner from the panel structure; and wherein the first exposed major surface of the second panel structure is adjacent to and faces the second exposed major surface of the panel structure.

17. A suspended ceiling system comprising:

a first overhead support member extending along a first longitudinal axis;

a panel structure having a first exposed major surface, a second exposed major surface, and a peripheral edge extending between the first and second exposed major surfaces of the panel structure; and a first mounting element comprising a first portion embedded between the first and second exposed major surfaces of the panel structure and a second portion protruding from the peripheral edge of the panel structure, the second portion comprising at least one connection feature configured for attachment to the first overhead support member to suspend the panel structure with the first and second exposed major surfaces in a vertical orientation relative to a plane of a ceiling; and wherein the first mounting element comprises a first major surface and an opposite second major surface that are parallel to the first and second exposed major surfaces of the panel structure, and wherein the at least one connection feature comprises a mounting flange extending from one of the first and second major surfaces of the first mounting element in a perpendicular manner, the mounting flange comprising a second opening extending therethrough; and wherein the second portion of the first mounting element is coupled to the first overhead support member such that the panel structure is suspended from the first overhead support member.

18. The ceiling system of claim 17 wherein the at least one connection feature is coupled directly to a vertically oriented portion of the first overhead support member.

19. The ceiling system of claim 17 wherein the peripheral edge comprises the top edge, a bottom edge, a first lateral edge, and a second lateral edge, the panel structure extending along an axis from the bottom edge to the top edge, and wherein the second portion of the first mounting element protrudes from the top edge of the panel structure in a direction of the axis of the panel structure.

* * * * *